US008007296B2

(12) United States Patent
Chen et al.

(10) Patent No.: US 8,007,296 B2
(45) Date of Patent: Aug. 30, 2011

(54) SAFETY GATES FOR ELECTRICAL OUTLETS

(75) Inventors: Gui Chen, Yueqing (CN); Jiayu Zhang, Fengyan Town (CN)

(73) Assignee: Gui Chen, Yueqing, Zhejiang Province ( * ) Notice: Subject to any disclaimer, the term of this patent is extended or adjusted under 35 U.S.C. 154(b) by 0 days.

(21) Appl. No.: 12/817,444

(22) Filed: Jun. 17, 2010

(65) Prior Publication Data

US 2011/0104918 A1 May 5, 2011

(30) Foreign Application Priority Data

Oct. 29, 2009 (CN) ..... 2009 1 0154474

(51) Int. Cl.
*H01R 13/44* (2006.01)

(52) U.S. Cl. ..... 439/136

(58) Field of Classification Search ..... 439/135–137
See application file for complete search history.

(56) References Cited

U.S. PATENT DOCUMENTS 7,312,963 B1 12/2007 Radosavljevic et al.
7,645,148 B2 * 1/2010 Carbone et al. ..... 439/137

* cited by examiner

*Primary Examiner* — Javaid Nasri
(74) *Attorney, Agent, or Firm* — Mei & Mark LLP

(57) ABSTRACT

A safety gate for selectively covering socket holes of an electrical outlet comprises an upper slide plate comprising an upper space with an upper recessed platform on a first side and an upper slant on an opposed side. A lower slide plate comprises a lower space with a lower slant on a first side and a lower recessed platform on an opposed side. The upper and lower spaces allow load plug pins to pass through, and the intervals of the spaces correspond to the interval of load plug pins. The upper slide plate is stacked with the lower slide plate to overlap the upper recessed platform with the lower slant and the upper slant with the lower recessed platform. The upper slide plate slides relative to the lower slide plate. Load plug pins slide along the inclined slopes of the upper and lower slants to slidingly displace the upper and lower slide plates a distance that is no less than the thickness of a pin.

18 Claims, 18 Drawing Sheets

SAFETY GATES FOR ELECTRICAL OUTLETS

This application claims the benefit of priority of Chinese patent application 200910154474.0, filed Oct. 29, 2009, the content of which is incorporated herein by reference in its entirety.

TECHNICAL FIELD

The present disclosure relates generally to a power outlet, especially a safety outlet that can prevent electroshock accidents caused by insertion of foreign objects into the live parts of the outlet. Safety gate mechanisms allow entry of power plugs while blocking foreign objects.

BACKGROUND

Along with the economic development, technical progress, and improvement of people's living standards, the electrical appliances in residents' houses increase in number, and so the outlets used increase in number. The structure of a normal outlet normally includes the case and the electrodes in the case, which are made of a metal material to match the plug pins. Socket holes are provided on the case at the positions corresponding to the electrodes.

Along with technical developments, the functions of outlets are more varied, and the need for safety becomes higher and higher. An example of such outlets is the GFCI, i.e. a grounding fault circuit interrupter, which has increasingly more applications. A normal GFCI is composed of a base, upper cover with socket holes, leakage signal detection circuit, electromagnetic tripping device that acts under the control of the said leakage signal detection circuit, contact head assembly, grounding assembly, power input connection assembly, and load connection assembly, etc. A GFCI power input connection assembly and load connection assembly are both provided with conductive terminal lugs. The conductive terminal lugs are inserted on the side inner walls of the base. At the positions on the side inner walls of the base corresponding to the conductive terminal lugs, notches are provided to expose the conductive terminal lugs. Therefore, a GFCI can provide loads with a power supply not only through the socket holes on the upper cover, just like a traditional outlet, but also through the load connection assembly. A GFCI can also provide protection in case of electrical leakage in the loads connected with the outlet.

However, for either of the traditional or GFCI outlets, hidden danger exists because the socket holes are open. Due to curiosity, children often poke the socket holes with objects. If the objects are made of conductive material, a casualty accident may occur in all probability.

For this reason, some outlets with safety gate devices have been developed over the years, for example, U.S. Pat. No. 7,312,963. However, the structure of the safety gate device socket is quite complicated. In addition, the safety gates of the example structure have poor universality. They are only applicable to rated current outlets of 15 A or lower, i.e. the planes of the two live plug pins are parallel. The safety gates are not applicable to the outlets with a rated current of 20 A or above. This is because the two live socket holes of the same group of socket holes in an outlet with a rated current of 15 A or below are a pair of long slots provided in parallel, while in an outlet with a rated current of 20 A or above, the planes corresponding to the two live pins of the plug are perpendicular with each other. Therefore, in an outlet with a rated current of 20 A or above, a live socket hole in each group of socket holes is T-shaped, simultaneously matching the plugs with a rated current of both 15 A or below and 20 A or above. However, an outlet with a corresponding safety gate structure is not available up to now.

SUMMARY

The purpose of the safety gate mechanisms is to overcome the disadvantage of the existing technology and to provide a safe outlet with a more simple structure that can prevent electroshock accidents caused by contact with live components in the outlet.

In one embodiment, a safety gate for selectively covering socket holes of an electrical outlet comprises an upper slide plate comprising an upper recessed platform, an upper space, and an upper slant and a lower slide plate comprising a lower slant, a lower space, and a lower recessed platform. The upper space and the lower space are configured to allow load plug pins to pass through, and the intervals of the upper space and the lower space are configured to correspond to the interval of the load plug pins. The upper recessed platform is on a first side of the upper space and the upper slant is on an opposed side of the upper space. The lower slant is on a first side of the lower space and the lower recessed platform is on an opposed side of the lower space. The slope of the upper slant and the slope of the lower slant are in the same direction. The upper slide plate is stacked with the lower slide plate such that the upper recessed platform overlaps with the lower slant and the upper slant overlaps with the lower recessed platform. The upper slide plate is configured to slide relative to the lower slide plate. The inclination of the slope of the upper slant and the inclination of the slope of the lower slant are configured to interact with the load plug pins such that the load plug pins slide along the slopes and slidingly displace the upper slide plate and the lower slide plate a distance, and the sliding distance for each of the upper slide plate and the lower slide plate is no less than the thickness of the pins.

In another embodiment, a safety gate for selectively covering socket holes of an electrical outlet comprises an upper slide plate comprising an upper recessed platform, an upper space, and an upper slant. A lower slide plate comprises a lower slant, a lower space, and a lower recessed platform. A side slide plate comprises a side slant and a groove. The upper space and the lower space are configured to allow load plug pins to pass through, and the intervals of the upper space and the lower space are configured to correspond to a spacing interval of the load plug pins. The upper recessed platform is on a first side of the upper space and the upper slant is on an opposed side of the upper space. The lower slant is on a first side of the lower space and the lower recessed platform is on an opposed side of the lower space. The slope of the upper slant and the slope of the lower slant are in the same direction. The upper slide plate is stacked with the lower slide plate such that the upper recessed platform overlaps with the lower slant and the upper slant overlaps with the lower recessed platform. At least one of the lower slant or upper slant corresponds to a long slot-shaped socket hole. At least one of the upper recessed platform or the lower recessed platform further comprises a protruding check block. The upper slide plate is configured to slide relative to the lower slide plate, and the lower slide plate is configured to slide relative to the upper slide plate. The inclination of the slope of the upper slant and the inclination of the slope of the lower slant are configured to interact with the load plug pins such that the load plug pins slide along the slopes and slidingly displace the upper slide plate and the lower slide plate a distance in a direction away from the side slide plate, and the sliding distance for each of the upper slide plate and the lower slide plate is no less than the thickness of a load plug pin. The groove of the side slide plate abuts the protruded check block. The side slide plate is configured to slide in a direction perpendicular to the relative sliding of the upper slide plate and the lower slide plate. At least one of the upper slant or the lower slant is higher than the side slant so that when at least one of the upper slant or the lower slant interacts with a pin of the load plug, the at least one of the upper slant or the lower slant moves the check block away from the groove.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

Implementation Example 1

Figure 1:
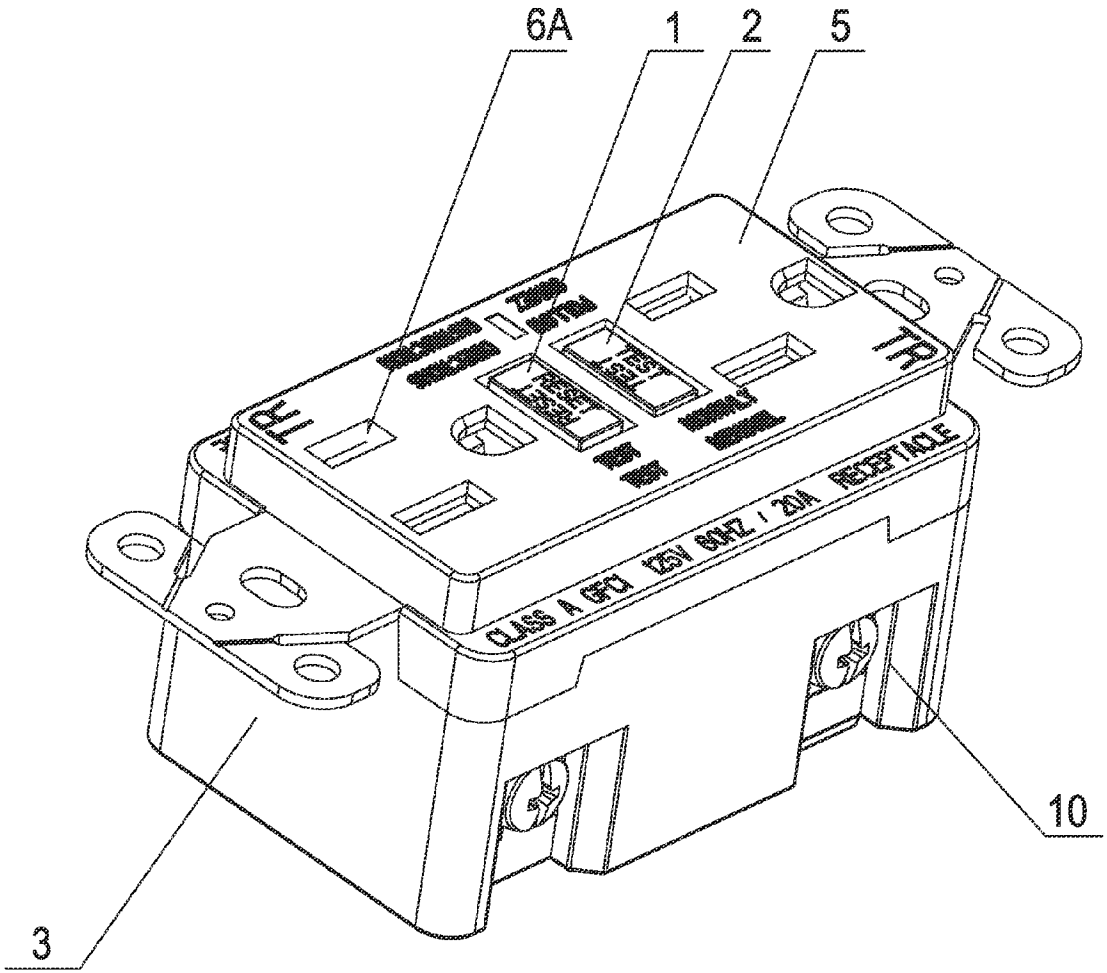
FIG. 1 is an example of a 15 A GFCI socket with an upper cover removed.
Figure 2:
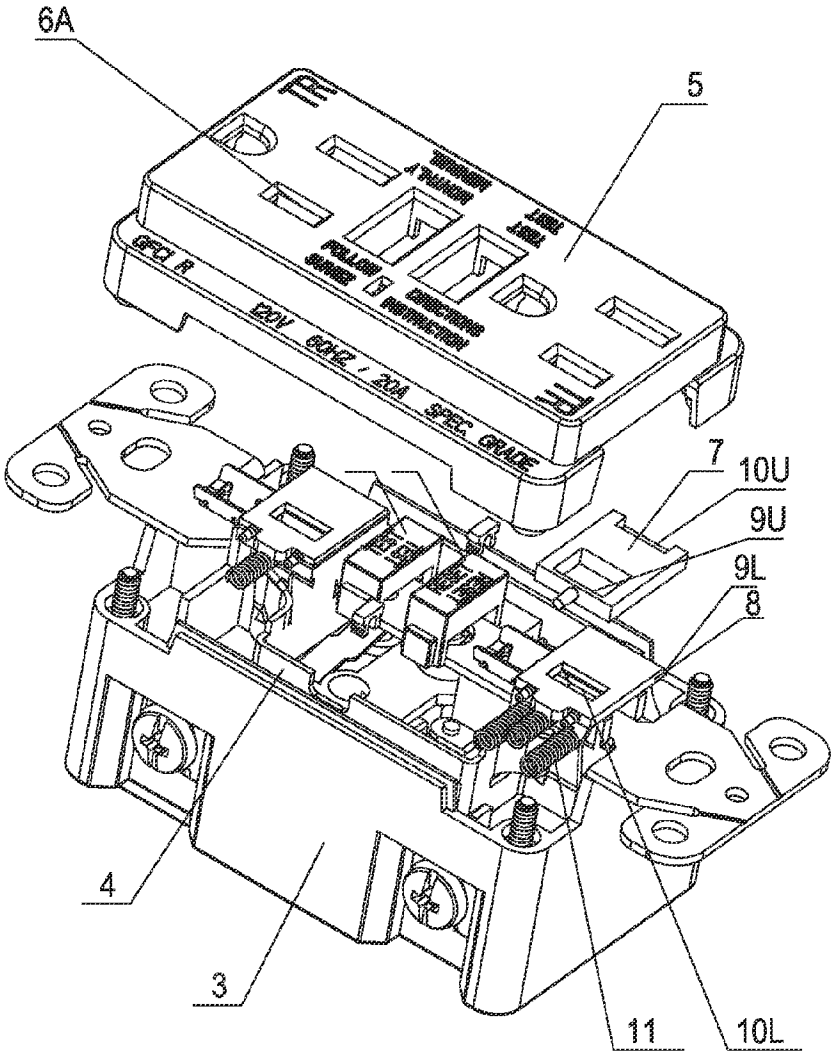
FIG. 2 is an example of an internal structural diagram of a 15 A GFCI socket with the upper cover removed.

As shown in FIGS. 1 and 2, using the outlet-type grounding fault circuit interrupter with a rated current of 15 A as an example for a safety outlet, the structure includes a case, leakage signal detection circuit, electromagnetic tripping device that acts under the control of the leakage signal detection circuit, resetting button 1, test button 2, grounding assembly, power input connection assembly, and load connection assembly. The load connection assembly includes output wiring assembly and output outlet assembly.

The outlet-type grounding fault circuit interrupter of this example is of rectangular shape. The case is composed of a base 3, middle frame 4, and upper cover 5. The upper cover 5 is provided with 2 groups of socket holes 6A, a resetting button 1 and a test button 2. Each group of socket holes 6A includes a ground electrode socket hole and phase and zero (hot and neutral) electrode socket holes composed of a pair of long slots provided in parallel. The socket holes are arranged as a triangle.

In the base 3 at the positions corresponding to socket holes 6A, electrodes are provided to match the plug pins of an electrical load device. Inside the cavity of the base 3, a base plate composed of a printed circuit is affixed to the lower end face of the middle frame 4. The leakage signal detection circuit and the electromagnetic tripping device that acts under the control of the leakage signal detection circuit are provided on the base plate. The power input connection assembly and load connection assembly are both provided with conductive terminal lugs. The conductive terminal lugs are inserted on the side inner walls of the base. At the positions on the side inner walls of the base corresponding to the conductive terminal lugs, windows are provided to expose the conductive terminal lugs.

Figure 3:
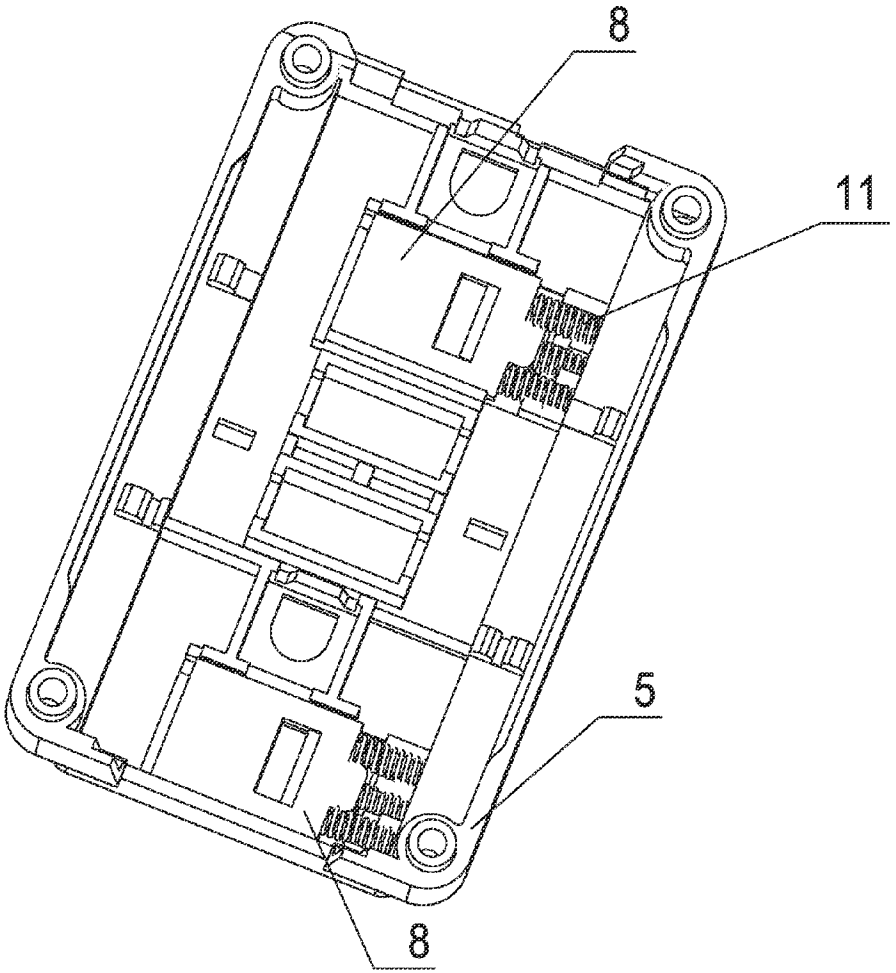
FIG. 3 is an example of an installation diagram of a safety gate mechanism for a 15 A GFCI socket.
Figure 4:
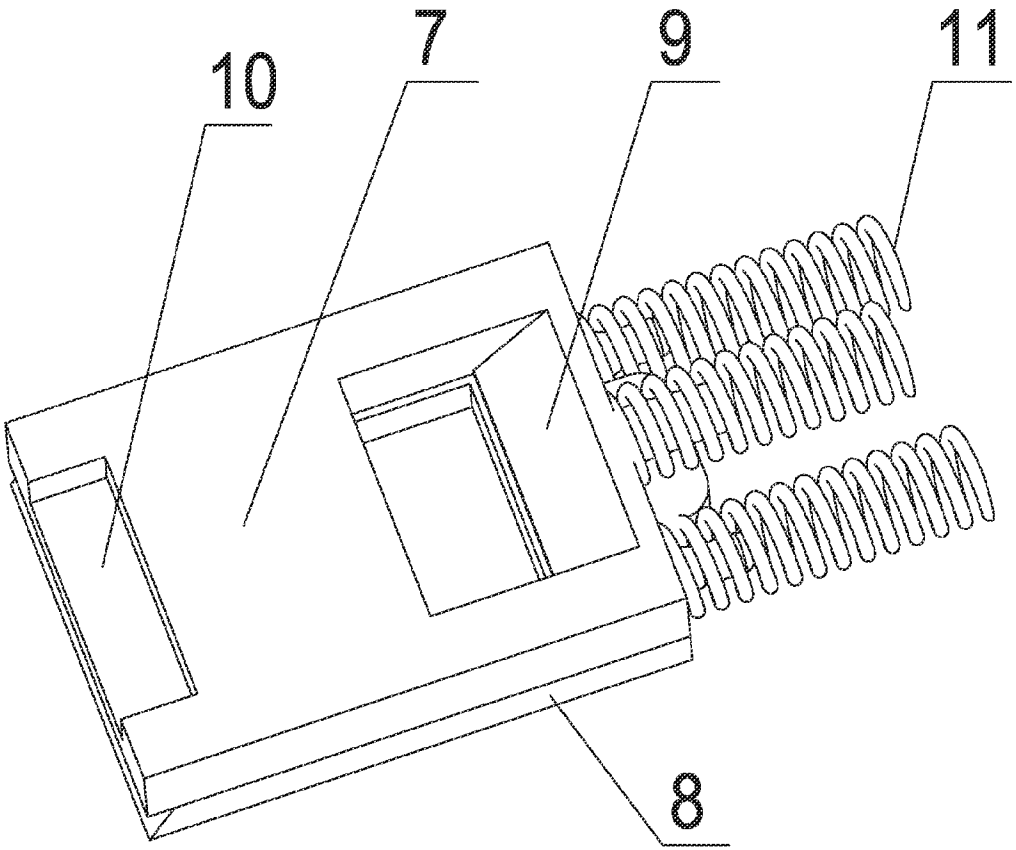
FIG. 4 is an example of a structural diagram of a safety gate mechanism for a 15 A GFCI socket.
Figure 5:
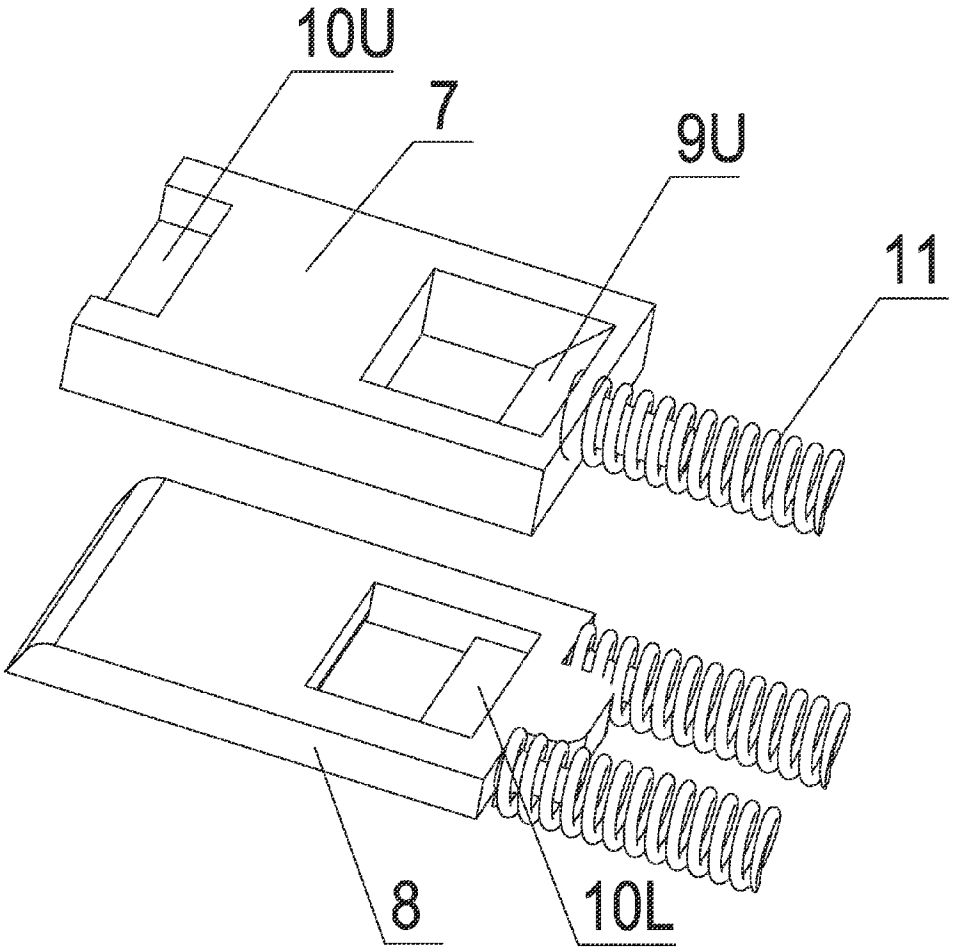
FIG. 5 is a structural breakdown diagram of an exemplary safety gate mechanism.
Figure 6:
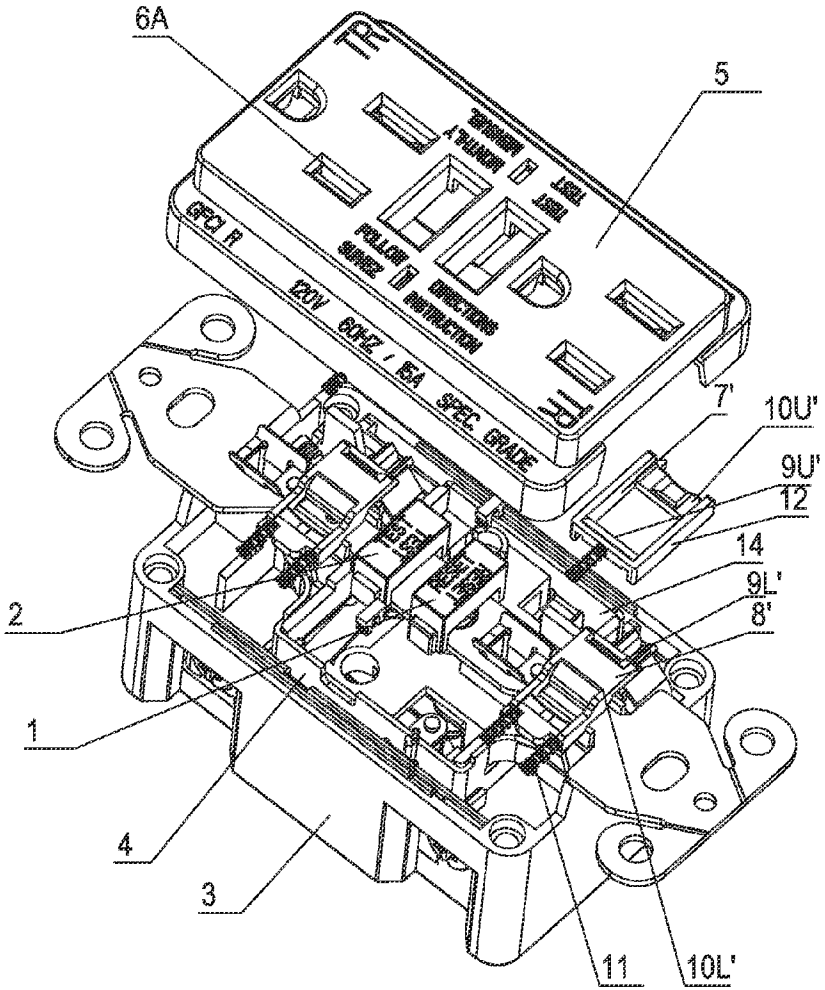
FIG. 6 is another example of an internal structural diagram of a 15 A GFCI socket with an upper cover removed.
Figure 7:
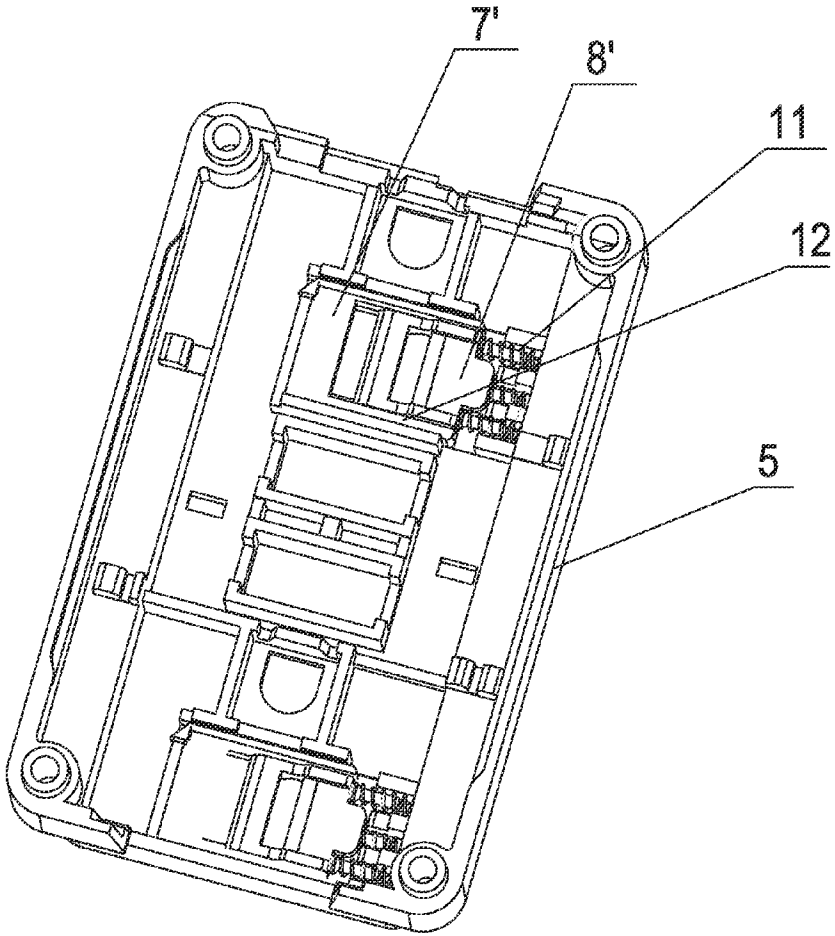
FIG. 7 is an example of an installation diagram of a safety gate mechanism for a 15 A GFCI socket.

As shown in FIGS. 4 and 5, the safety gate mechanism includes upper slide plate 7, lower slide plate 8, and their resetting mechanisms 11. Upper slide plate 7, lower slide plate 8, and their resetting mechanisms are provided between the back of the upper cover 5 and the electrode. Referring to FIGS. 2 and 3, the shape and size of upper slide plate 7 and lower slide plate 8 shall match with the internal space.

As shown in FIGS. 4 and 5, in this example, upper slide plate 7 and lower slide plate 8 are both rectangular tabular components. Both upper slide plate 7 and lower slide plate 8 are provided with space for the plug pins to pass through. The space can be a window provided on the slide plate, a notch at the edge of the slide plate, or a space outside the edge of the slide plate. The interval of the space corresponds to the interval of the plug pins.

In this example, windows are provided on upper slide plate 7 and lower slide plate 8 respectively as one of the spaces for plug pins to pass through. As for the other space for plug pins to pass through, the space outside the edge of the slide plate is used directly. In this way, upper slide plate 7 and lower slide plate 8 can be relatively small. The window is close to a short side of upper slide plate 7 and lower slide plate 8.

In the same side of the above window on upper slide plate 7 and lower slide plate 8, i.e. the side close to the short side, an upper slant 9U and a recessed lower platform 10L are provided respectively. On the other short side of upper slide plate 7 and lower slide plate 8, a lower slant 9L and an upper recessed platform 10U are provided respectively. That is to say, upper slide plate 7 and lower slide plate 8 each have a slant 9U and 9L and a recessed platform 10U and 10L respectively, with the length of the slants 9U and 9L and platforms 10U and 10L no less than the length of the long slot and with the width no less than the width of the long slot to ensure complete covering of the socket holes.

Upper and lower slants 9U and 9L of upper slide plate 7 and lower slide plate 8 are consistent in direction, and can be stacked together in a sliding way. Upper slant 9U of upper slide plate 7 overlaps with lower platform 10L of lower slide plate 8 and lower slant 9L of lower slide plate 8 overlaps with upper platform 10U of upper slide plate 7. Either of upper slide plate 7 and lower slide plate 8 can be placed upwards as the uppermost slide plate.

The inclination of the slopes of upper slant 9U and lower slant 9L shall ensure that, when the slopes interacts with a pin of the plug and slides, the sliding displacement before the other pin contacts with platform 10 in the corresponding position should be no less than the thickness of the pin so that respective upper and lower platforms 10U and 10L slide away from the socket hole to allow the plug to be inserted in smoothly. Therefore, the horizontal displacement from the highest points on upper and lower slants 9U and 9L to the positions with equal height as upper and lower platforms 10U and 10L is no less than the thickness of the pin, preferably no less than the width of the long slot.

The distance from the edge of upper and lower platforms 10U and 10L to the positions on respective upper and lower slants 9U and 9L with equal height as platforms 10U and 10L is no more than the interval between the two pins of the plug. Upper slide plate 7 and lower slide plate 8 are affixed to the back of the case corresponding to socket holes 6A in a sliding way, with the sliding direction perpendicular to the long slot. The resetting resilience direction of the said resetting device is contrary to the sliding direction in the interaction between upper and lower slants 9U and 9L and the pins.

Upper and lower slants 9U and 9L and upper and lower platforms 10U and 10L are aligned with the long slot of socket holes 6A in order to cover socket holes 6A. As shown in FIGS. 2-4, the resetting mechanism can comprise compression springs 11 provided at the corresponding side of upper slide plate 7 and lower slide plate 8. One end of each of the compression springs rests against the end face of upper slide plate 7 and lower slide plate 8, while the other ends rest on the inner wall of the upper cover 5.

As compared with the existing technology, the structure of the safety gate device is very simple since it includes only an upper slide plate, lower slide plate, and their resetting devices. Moreover, this structure can match to an outlet of 20 A rating or above through simple further setting.

The principle of this safety socket is as follows: It has an upper slide plate and a lower slide plate, each being provided with a slant and a recessed platform respectively. The slant of the upper slide plate overlaps with the platform of the lower slide plate, while the slant of the lower slide plate overlaps with the platform of the upper slide plate. When a load plug is not inserted, the slants and platforms of the upper and lower slide plates, under the action of their resetting devices, are aligned with the socket holes and close the socket holes off from access. When a foreign object pokes any socket hole, it will firstly contact with the slant or platform. The platform, for lack of the slant structure, will not move, preventing the foreign object from further entering to contact with the electrode. In this way, the protective function is realized.

When a slant is located below the socket hole, under the action of the slant, the slide plate will be pushed to one side. However, because of the platform of the other slide plate under it, it can still prevent the foreign object from further entering to contact with the electrode, realizing the protective function.

But when a plug is inserted, the pin corresponding to the slant socket pushes the slide plate to slide to one side while pushing the platform under the other socket to slide away from the socket. In this way, the plug can be inserted in smoothly and can be used normally.

Implementation Example 2

Figure 8:
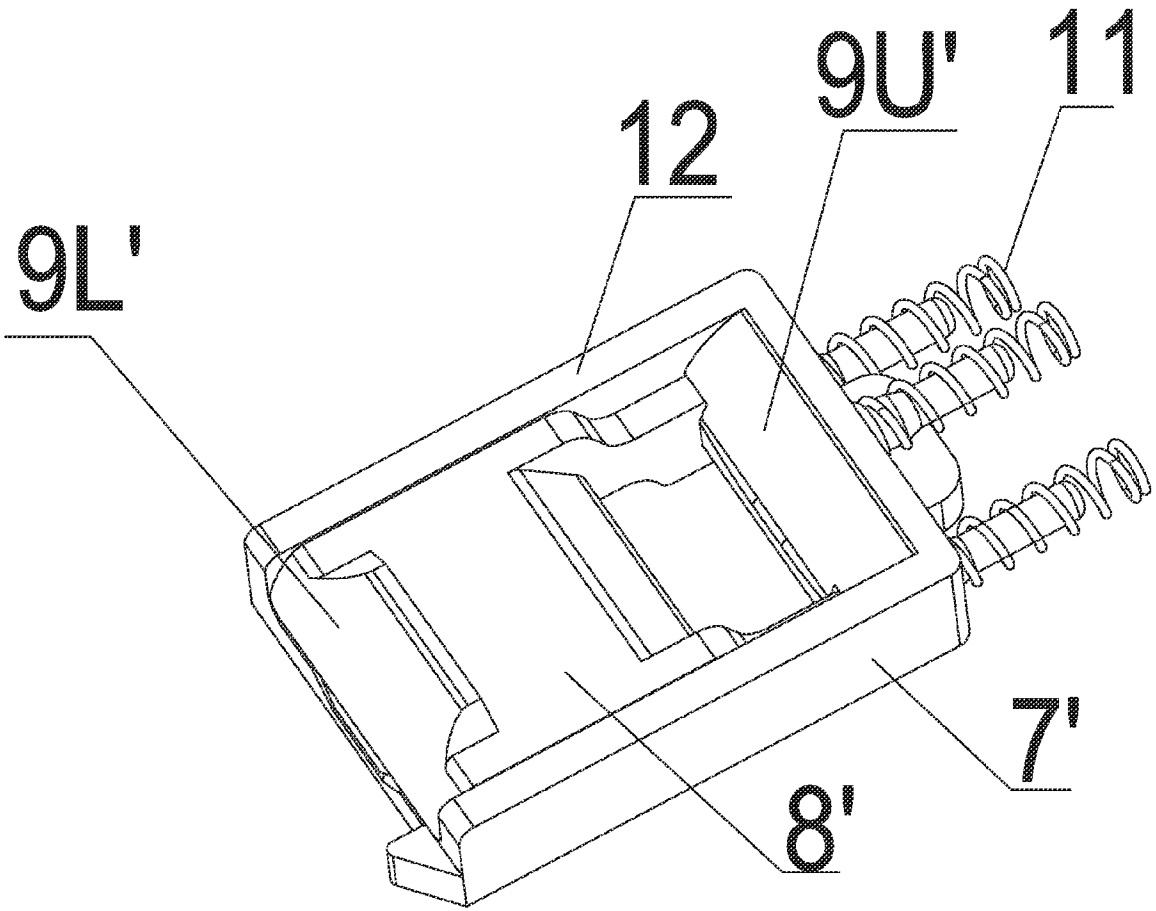
FIG. 8 is another structural diagram of an exemplary safety gate mechanism for a 15 A GFCI socket.
Figure 9:
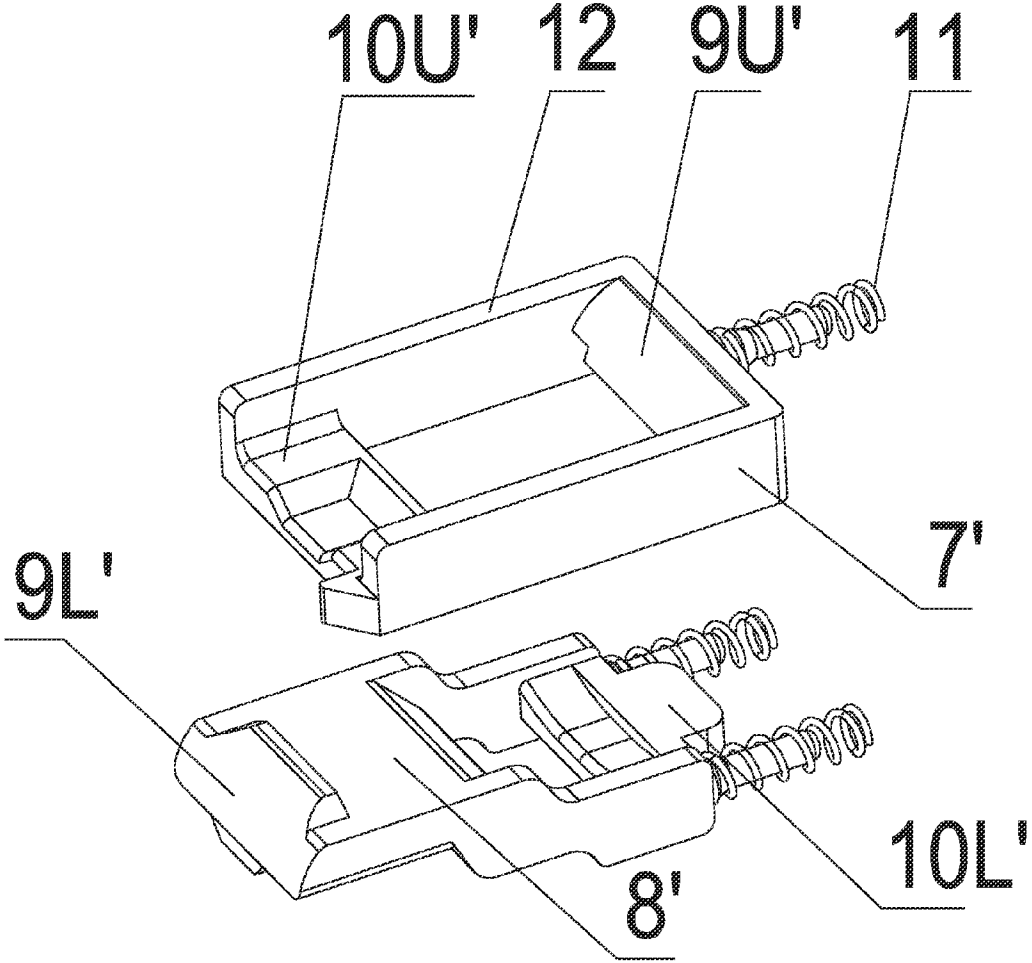
FIG. 9 is a structural breakdown diagram of an exemplary safety gate mechanism for a 15 A GFCI socket.

Besides the case shown in Implementation example 1, upper slide plate 7 in the safety gate mechanism can also be a tabular frame component. As shown in FIGS. 8 and 9, the section of lower slide plate 8' is a Z shape. The window on upper slide plate 7' makes the space for the plug pins to pass through. The edge of the window close to the short side is configured as the structure of upper slant 9U'. The surface of the other end is relatively low, and makes the upper platform 10U'.

The horizontal displacement from the highest point on upper slant 9U' of upper slide plate 7 to the position with equal height as upper platform 10U' is no less than the thickness of the pin. One end of the slant of lower slide plate 8' penetrates through the center window of upper slide plate 7', and is stacked on upper platform 10U' of upper slide plate 7' in a sliding way. The edge of this side of lower slide plate 8' is provided with lower slant 9'. In the two sides of upper platform 10U' of upper slide plate 7', it is preferable to provide a rib 12 for guidance. The horizontal displacement between the highest point and the lowest point on lower slant 9L' of lower slide plate 8' is no less than the thickness of the load pin. The distance from the edge of upper platform 10U' of upper slide plate 7' to the position on upper slant 9U' with equal height as upper platform 10U' is no more than the interval between the two pins of the plug load. The distance from the edge of lower platform 10L' of lower slide plate 8' to the lower edge of lower slant 9L' is no more than the interval between the two pins of the plug so that the plug can be inserted in smoothly.

The principle of this safety outlet is as follows: When a load plug is not inserted, upper and lower slants 9U' and 9L' and upper and lower platforms 10U' and 10L' of upper slide plate 7' and lower slide plate 8', under the action of their resetting devices 11, are aligned with the socket holes and close them. When a foreign object pokes any socket hole, it will firstly contact with upper or lower slant 9U' or 9L' or upper or lower platform 10U' or 10L'. Upper platform 10U', for lack of the motion of the structure of upper slant 9U', will not move, thereby preventing the foreign object from further entering to contact the electrode. Likewise, lower platform 10L', for lack of the motion of the structure of lower slant 10L', will not move, thereby preventing the foreign object from further entering to contact the electrode. In this way, the protective function is realized.

When an upper or lower slant 9U' or 9L' is located below the socket hole, under the action of upper or lower slant 9U' or 9L', the corresponding slide plate will be pushed to one side. However, because of the corresponding upper or lower platform 10U' or 10L' of the other slide plate under it, the safety gate mechanisms can still prevent the foreign object from further entering to contact with the electrode, realizing the protective function.

But when a plug is inserted, each pin corresponding to socket holes associated with upper and lower slant 9U' and 9L' pushes the respective slide plates to slide to one side which also pushes upper and lower platforms 10U' and 10L' to slide away from the socket holes. In this way, the plug can be inserted smoothly and can be used normally.

The other purpose of this invention is to provide a safety outlet that can match two types of load plugs at the same time, i.e. plugs with a rated current of 15 A and plugs with rated current of 20 A or above. This purpose is achieved in implementation examples 3 and 4, below.

Implementation Example 3

Figure 10:
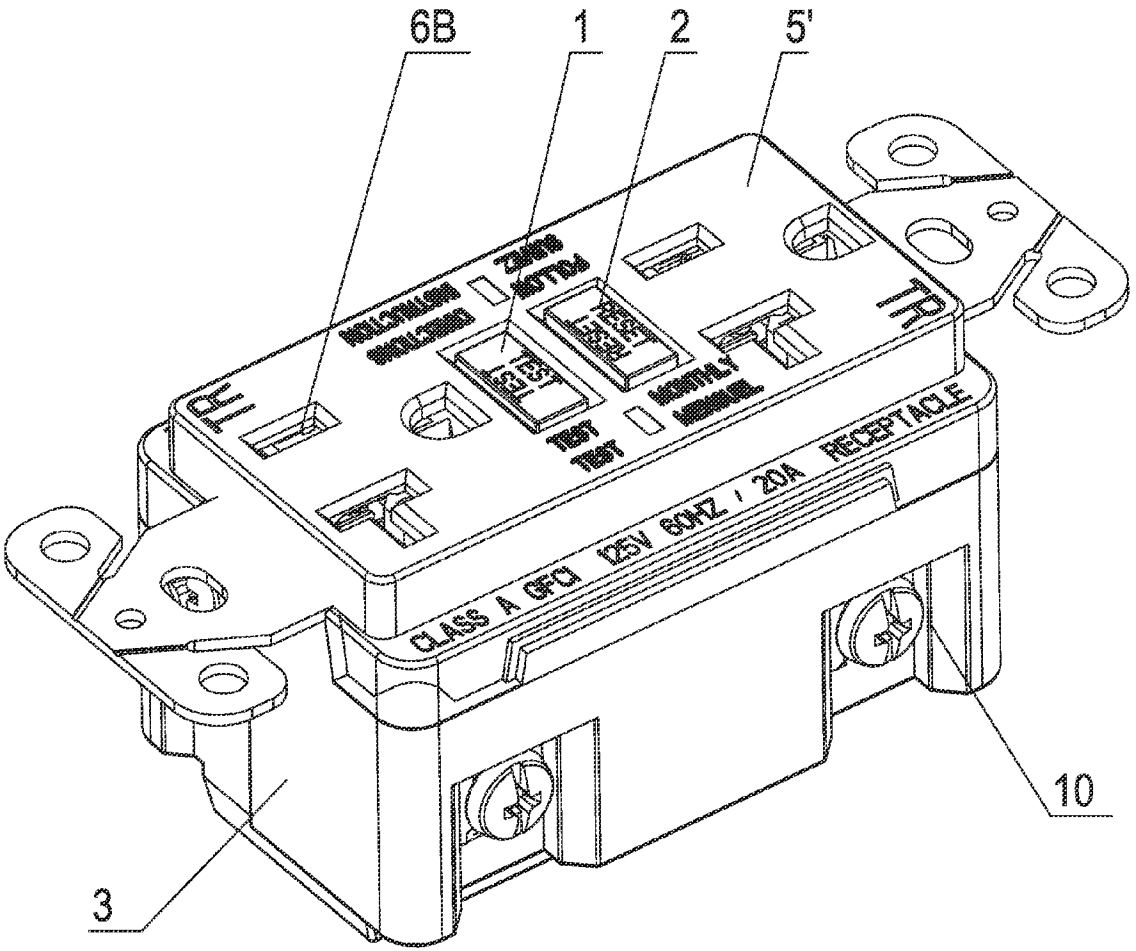
FIG. 10 is an example of an external 3-dimensional diagram of a 20 A GFCI socket.
Figure 11:
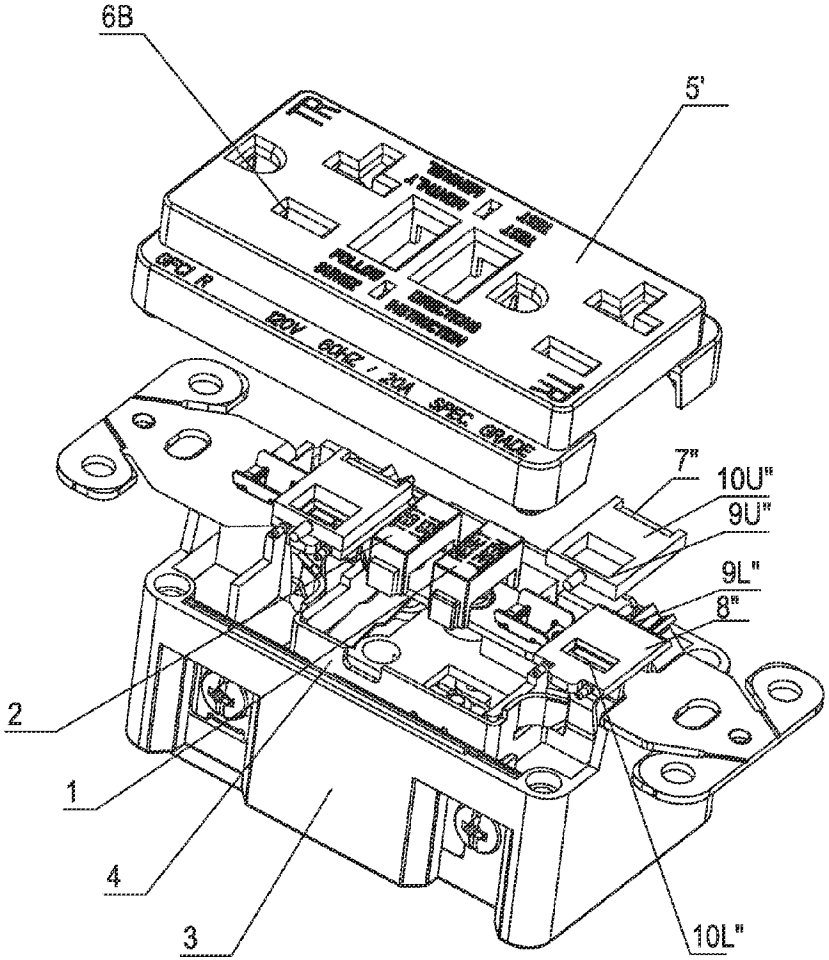
FIG. 11 is an example of an internal structural diagram of a 20 A GFCI socket with an upper cover removed.

A safety outlet of an outlet-type grounding fault circuit interrupter with a rated current of 20 A is taken as an example. As shown in FIGS. 10 and 11, the outlet includes the case and the electrodes in the case to match plug pins. Two groups of socket holes 6B are provided on the case corresponding to the electrodes. Each group of socket holes includes a ground electrode socket hole, a T-shaped hole and a long-slot hole in parallel with the cross strip of the T-shaped hole. The socket holes are arranged as a triangle.

Figure 13:
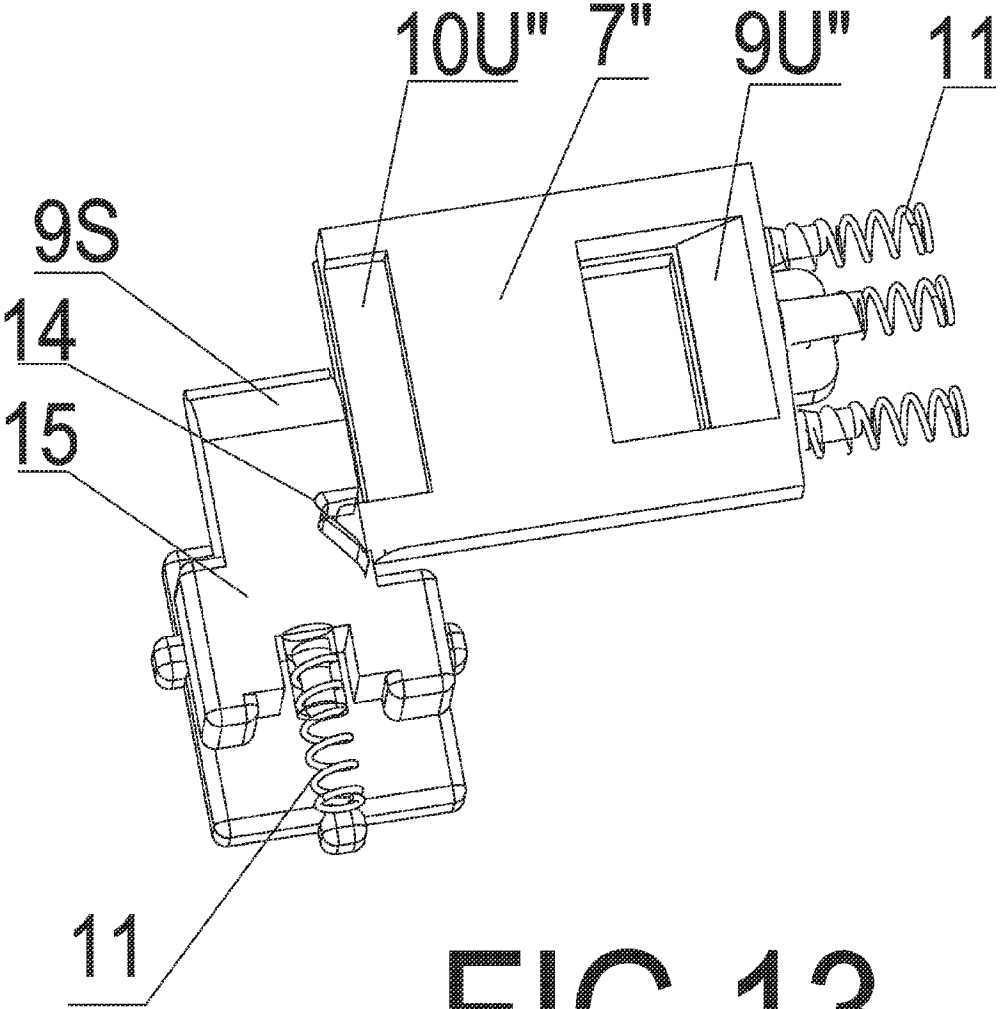
FIG. 13 is a structural diagram for an exemplary safety gate mechanism for a 20 A GFCI socket.
Figure 14:
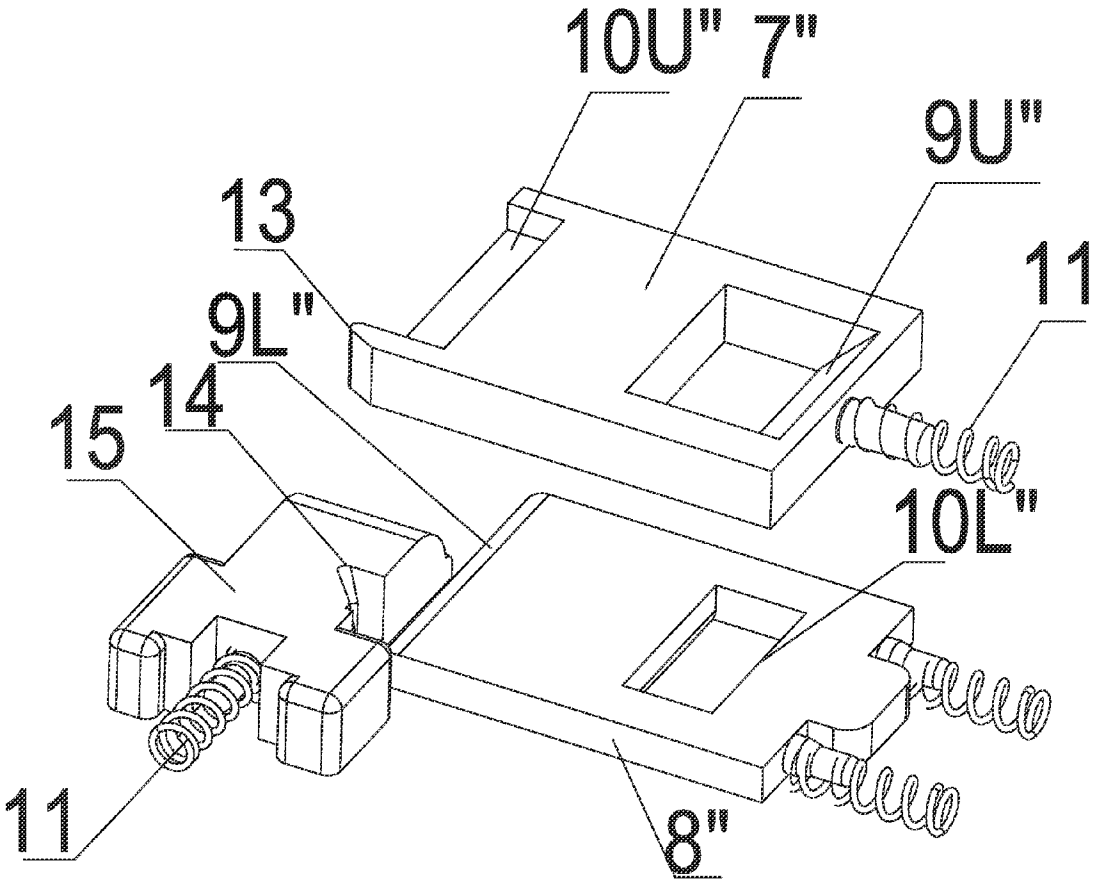
FIG. 14 is an example of a structural breakdown diagram of a safety gate mechanism for a 20 A GFCI socket.

Safety gate mechanisms are provided in the case. The safety gate mechanisms includes upper slide plate 7", lower slide plate 8", side slide plate 15 and their resetting mechanisms 11, as shown in FIGS. 13 and 14. The structure of upper slide plate 7" and lower slide plate 8" is similar to that in Implementation example 1. Upper and lower slants 9U" and 9L" of upper slide plate 7" and lower slide plate 8" are consistent in direction, and can be stacked together in a sliding way.

Upper slant 9U" of upper slide plate 7" is provided at the window side, while lower slant 9L" of lower slide plate 8" is provided at the edge of the short side. Upper and lower slants 9U" and 9L" are oriented to make upper and lower slide plate 7" and 8" slide away from the side plate 15. Furthermore, upper slant 9U" of upper slide plate 7" overlaps with lower platform 10L" of lower slide plate 8" and lower slant 9L" of lower slide plate 8" overlaps with upper platform 10" of upper slide plate 7". Upper slant 9" of upper slide plate 7" corresponds to the long slot. A protruded check block 13 is provided at the other end of upper slide plate 7".

The inclination of the slope of upper and lower slants 9U" and 9L" shall ensure that, when the slope interacts with a pin of the plug and slides, the sliding displacement before the other pin contacts with an upper or lower platform 10U" or 10L" in the corresponding position should be no less than the thickness of the pin.

Figure 12:
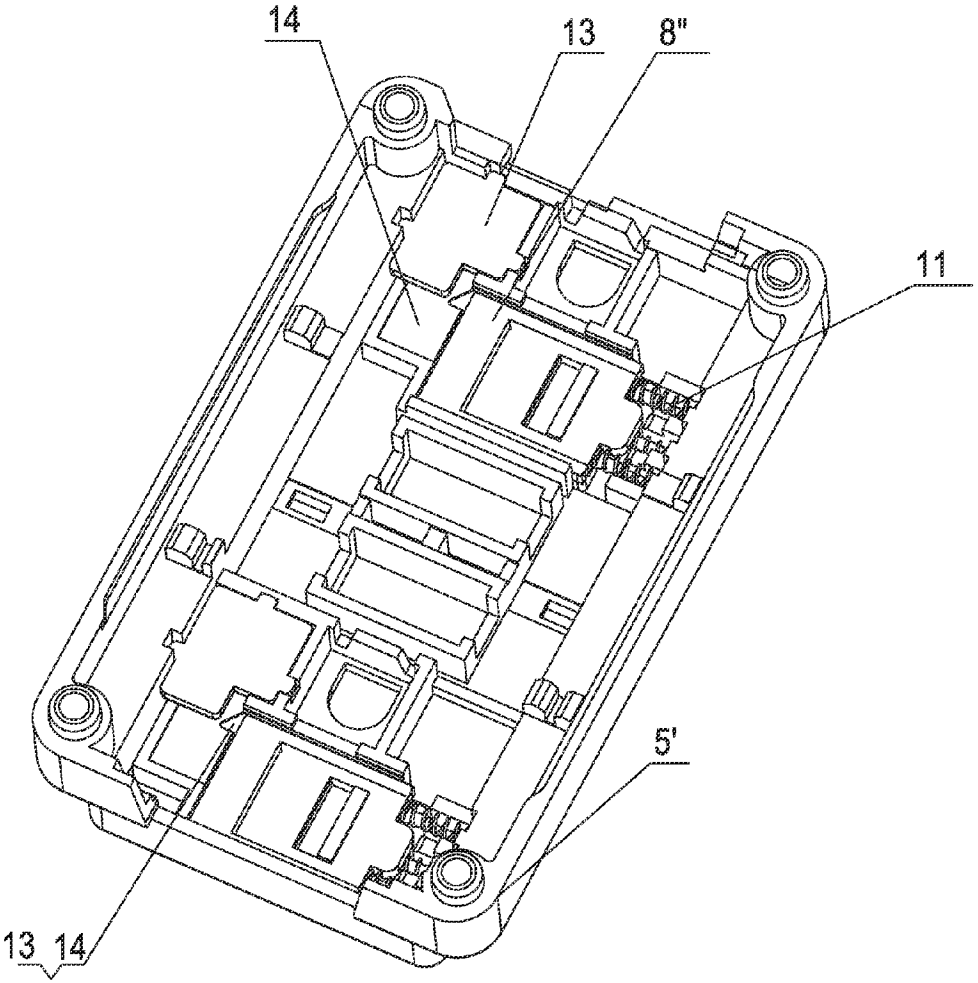
FIG. 12 is an example of an installation diagram of a safety gate mechanism for a 20 A GFCI socket.

As shown in FIGS. 11 and 12, the upper slide plate 7" and lower slide plate 8" are affixed to the back of the case corresponding to the locations of socket holes 6B. The resetting resilience directions of the said resetting devices 11 is contrary to the sliding direction in the interaction between upper and lower slants 9U" and 9L" and the pins. Upper and lower slants 9U" and 9L" and platforms 10U" and 10L" are aligned with the cross strip of the T-shaped hole and the long slot in socket holes 6B. It is preferable that the sliding pathway of the check block 13 should not pass below the cross strip of the T-shaped hole to allow a relatively thin size of upper slide plate 7" and lower slide plate 8".

As shown in FIGS. 13 and 14, side slide plate 15 is generally rectangular, with the long side mated to upper slide plate 7" at the end with protruded check block 13 provided. The sliding direction of side slide plate 15 is perpendicular to the movement direction of upper slide plate 7" and lower slide plate 8". At the side of the said side slide plate 15 close to the check block 13, a groove 14 or pit perpendicular to the sliding direction is provided. The said groove 14 or pit coordinates with the check block 13 to form a check mechanism for the side slide plate 15. One end of the side slide plate 15 is close to the longitudinal strip part of the T-shaped hole, and has a side slant 9S to correspond to the longitudinal part of the T-shaped hole. Upper slant 9U" on upper slide plate 7" with check block 13 provided is higher than side slant 9S on side slide plate 15 to ensure that, when the plug pin contacts with side slant 9S on side slide plate 15, upper slant 9U" on upper slide plate 7" can slide for sufficient displacement under the action of the plug pin so that the check block could retreat from the groove 14 or pit.

The beneficial result as compared with the existing technology is as follows: The safety gate mechanism of this safety outlet includes upper slide plate, lower slide plate, side slide plate, and their resetting mechanisms. The slants of the upper and lower slide plates are consistent in direction, and can be stacked together in a sliding way. The slants are oriented to make the upper and lower slide plates slide away from the side plate. A protruded check block is provided at one end of the upper or lower slide plate. The side slide plate is affixed to the end of the slide plate where the protruded check block is provided. At the side of the said side slide plate close to the check block, a groove or pit perpendicular to the sliding direction is provided. The sliding direction of the side slide plate is perpendicular to the movement direction of the upper and lower plates. The upper and lower slide plates protect the long slots in the socket holes and the cross strip in the T-shaped hole. The side slide plate protects the longitudinal strip in the T-shaped hole. When the plug is inserted in, both the upper slide plate and the lower slide plate slide in the direction away from the side slide plate, making the check block retreat from the groove or pit of the side slide plate to unlock the side slide plate. Therefore, the safety gate mechanisms of implementation example 3 can protect the outlets for the plugs with a rated current of both 15 A and 20 A or above.

Implementation Example 4

Figure 15:
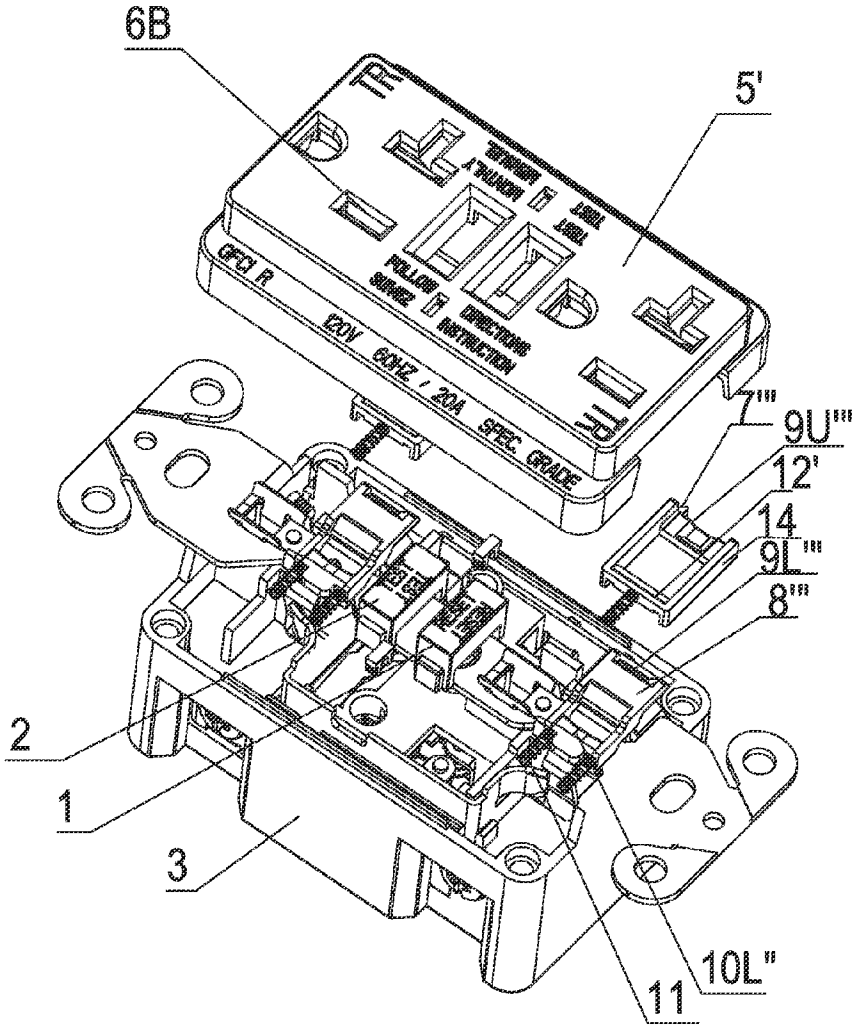
FIG. 15 is an example of an internal structural diagram of a 20 A GFCI socket with an upper cover removed.
Figure 16:
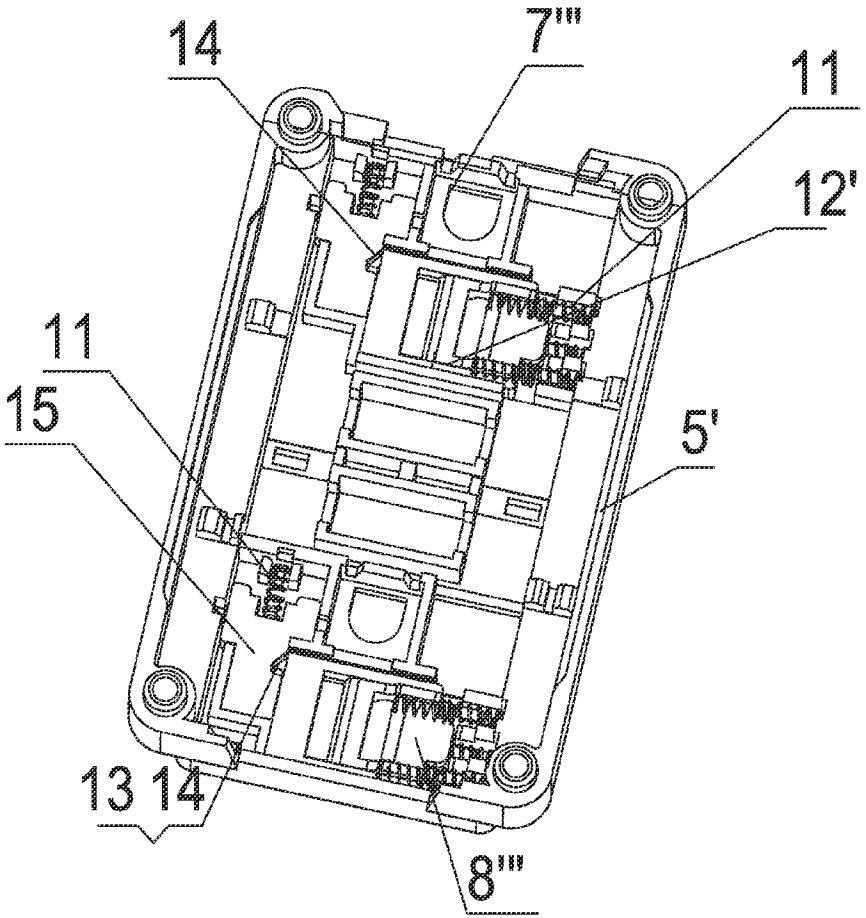
FIG. 16 is an example of an installation diagram of a safety gate mechanism for a 20 A GFCI socket.
Figure 17:
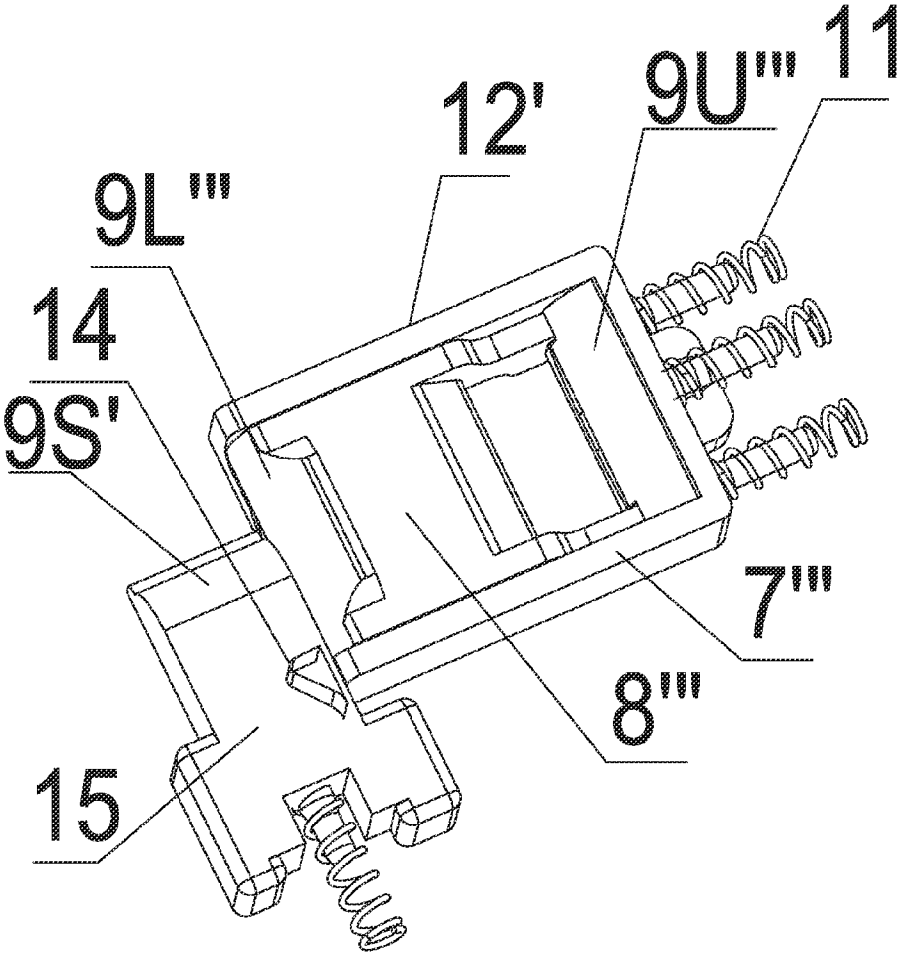
FIG. 17 is a structural diagram of an exemplary safety gate mechanism for a 20 A GFCI socket.
Figure 18:
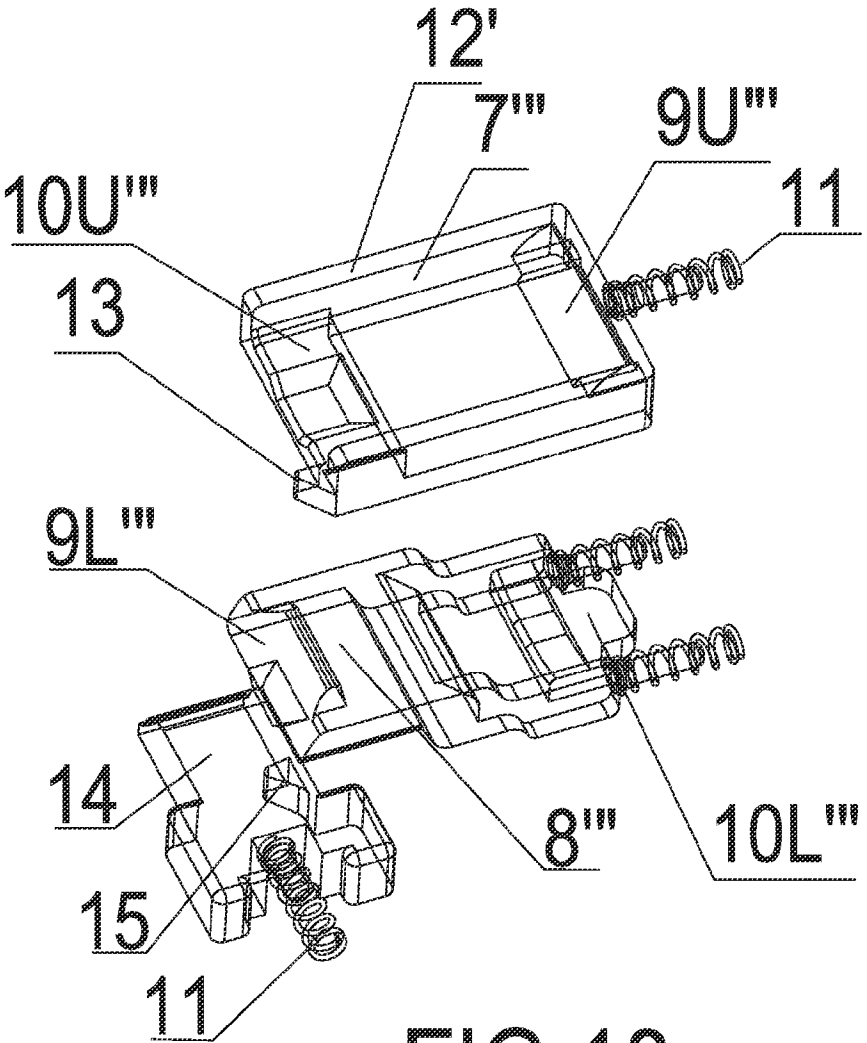
FIG. 18 is a structural breakdown diagram of an exemplary safety gate mechanism for a 20 A GFCI socket.

As the safety outlet, an outlet-type grounding fault circuit interrupter with a rated current of 20 A is taken as the example. As shown in FIG. 15, the structure of upper slide plate 7'" and lower slide plate 8'" of the safety gate mechanism is similar to that in Implementation example 2. As shown in FIGS. 17 and 18, in this implementation example, upper slide plate 7'" is a tabular frame component. The section of lower slide plate 8'" is of a Z shape. One end of lower slant 9L'" of lower slide plate 8'" penetrates through the center of upper slide plate 7'", and is stacked on upper platform 10'" of upper slide plate 7'". It is preferable that the two sides 12' of upper slide plate 7'" should be slightly higher to form a guiding structure. A check block 13 is provided at one end of upper platform 10U'" of upper slide plate 7'".

The horizontal displacement from the highest point on upper slant 9U'" of upper slide plate 7'" to the position on upper slant 9U'" with equal height as upper platform 10U'" is no less than the thickness of the load pin. The distance from the edge of upper platform 10U'" of upper slide plate 7'" to the position on upper slant 9U'" with equal height as upper platform 10U'" is no more than the interval between the two pins of the plug. The distance between the edge of lower platform 10L'" and the lower edge of lower slant 9L'" of lower slide plate 8'" is no more than the interval between the two pins of the plug.

As shown in FIG. 15, side slide plate 15 is mated to upper slide plate 7'" at the end with protruded check block 13 provided. The sliding direction is perpendicular to the movement direction of upper slide plate 7'" and lower slide plate 8'". At the side of side slide plate 15 close to the check block 13, a groove 14 or pit perpendicular to the sliding direction is provided. The groove 14 or pit coordinates with the check block 13 to form a check mechanism for the slide plate 15. One end of side slide plate 15 is close to the longitudinal strip part of the T-shaped hole, and has a side slant 9S to correspond to the longitudinal part of the T-shaped hole. Upper slant 9U'"

is higher than side slant 9S to ensure that, when the plug pin contacts with side slant 9S, upper slant 9U''' can slide for sufficient displacement under the action of the plug pin so that the check block 13 can retreat from the groove 14 or pit.

The operation principle of the safety gate mechanisms of the safety outlet with a rated current of 20 A is as follows: When a foreign object is inserted into the longitudinal strip of the T-shaped hole, as upper slant 9U''' of upper slide plate 7''' does not retreat under any force, the check block 13 on upper slide plate 7''' is still blocked in the groove 14 or pit in side slide plate 15. Therefore, side slide plate 15 can not move to expose the socket holes, and the protective purpose is achieved.

When a plug of a 15 A load is inserted in, the pin in the socket hole corresponding to upper and lower slants 9U''' and 9L''' pushes the slide plates to slide to one side, and meanwhile pushes upper and lower platforms 10U''' and 10L''' under the other socket hole to slide away from the socket hole. In this way, the plug can be inserted in smoothly and be used normally.

When a plug of a 20 A load is inserted in, the plug pin corresponding to the long slot firstly contacts with upper slant 9U''' on the upper slide plate 7''', making upper slide plate 7''' retreat. In the meantime, the check block 13 retreats out of the groove 14 or pit in side slide plate 15. The plug continues to be inserted in. When the plug pin corresponding to the longitudinal strip in the T-shaped hole contacts with side slant 9S of side slide plate 15, side slide plate 15 retreats to allow the plug to be inserted to position.

This invention is also applicable to the outlets of other types, including wall outlets, as long as the live socket holes in socket holes 6A or 6B are composed of two parallel long slots or of a T-shaped hole and a long slot parallel with the cross strip in the T-shaped hole. The corresponding safety gate mechanisms are provided behind socket holes 6A or 6B.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A safety gate for selectively covering socket holes of an electrical outlet, the safety gate comprising:

an upper slide plate comprising an upper recessed platform, an upper space, and an upper slant; and a lower slide plate comprising a lower slant, a lower space, and a lower recessed platform, wherein:

the upper space and the lower space are configured to allow load plug pins to pass through, and the upper space and the lower space are spaced apart to correspond to an interval of space between the load plug pins, the upper recessed platform is on a first side of the upper space and the upper slant is on an opposed side of the upper space, the lower slant is on a first side of the lower space and the lower recessed platform is on an opposed side of the lower space, a slope of the upper slant and a slope of the lower slant are in the same direction, the upper slide plate is stacked with the lower slide plate such that the upper recessed platform overlaps with the lower slant and the upper slant overlaps with the lower recessed platform, the upper slide plate is configured to slide relative to the lower slide plate, and the slope of the upper slant and the slope of the lower slant are configured to interact with the load plug pins such that the load plug pins slide along the slopes to slidingly displace each of the upper slide plate and the lower slide plate a sliding distance, and the sliding distance for each of the upper slide plate and the lower slide plate is no less than a thickness of a load plug pin.

2. The safety gate of claim 1, wherein:

the safety gate is configured to be installed in the electrical outlet and the electrical outlet comprises a case and electrodes in the case to match the load plug pins, the case comprises socket holes at positions corresponding to the electrodes, the socket holes comprise a pair of long slots provided in parallel, the upper slide plate and the lower slide plate are configured to affix to a portion of the case corresponding to the socket holes, and the upper slant, the lower slant, the upper recessed platform, and the lower recessed platform are configured to selectively vertically align to cover the socket holes.

3. The safety gate of claim 2, wherein:

the upper slide plate and the lower slide plate have a tabular structure, the upper recessed platform is vertically lower than a highest point on the upper slant, and a first horizontal displacement from the highest point on the upper slant to a position on the upper slant with a height equal to the upper recessed platform is no less than the thickness of a load plug pin, the lower recessed platform is vertically lower than a highest point on the lower slant, and a second horizontal displacement from the highest point on the lower slant to a position on the lower slant with a height equal to the lower recessed platform is no less than the thickness of the load plug pin, a first distance from an edge of the upper recessed platform to the position on the upper slant with the height equal to the upper recessed platform is no more than the interval of space between the load plug pins, and a second distance from an edge of the lower recessed platform to the position on the lower slant with the height equal to the lower recessed platform is no more than the interval of space between the load plug pins.

4. The safety gate of claim 2, wherein:

the upper slide plate is a tabular frame component, the lower slide plate is configured in a Z shape, a first end of the lower slide plate comprises the lower slant and the lower slant penetrates through the upper space and is stacked on the upper recessed platform, a first horizontal displacement from a highest point on the upper slant to a position on the upper slant that is an equal height to the upper recessed platform is no less than the thickness of the load plug pin, a second horizontal displacement between a highest point and a lowest point on the lower slant is no less than the thickness of the load plug pin, a distance from an edge of the upper recessed platform to the position on the upper slant that is the equal height to the upper recessed platform is no more than the interval of space between the load plug pins.

5. The safety gate of claim 1, further comprising resetting mechanisms, wherein the resetting mechanisms are configured to bias the upper slide plate and the lower slide plate against sliding displacement.

6. The safety gate of claim 5, wherein:

the upper slide plate and the lower slide plate have a tabular structure, the upper recessed platform is vertically lower than a highest point on the upper slant, and a first horizontal displacement from the highest point on the upper slant to a position on the upper slant with a height equal to the upper recessed platform is no less than the thickness of a load plug pin, the lower recessed platform is vertically lower than a highest point on the lower slant, and a second horizontal displacement from the highest point on the lower slant to a position on the lower slant with a height equal to the lower recessed platform is no less than the thickness of the load plug pin, a first distance from an edge of the upper recessed platform to the position on the upper slant with the height equal to the upper recessed platform is no more than the interval of space between the load plug pins, and a second distance from an edge of the lower recessed platform to the position on the lower slant with the height equal to the lower recessed platform is no more than the interval of space between the load plug pins.

7. The safety gate of claim 5, wherein:

the upper slide plate is a tabular frame component, the lower slide plate is configured in a Z shape, a first end of the lower slide plate comprises the lower slant and the lower slant penetrates through the upper space and is stacked on the upper recessed platform, a first horizontal displacement from a highest point on the upper slant to a position on the upper slant that is an equal height to the upper recessed platform is no less than the thickness of the load plug pin, a second horizontal displacement between a highest point and a lowest point on the lower slant is no less than the thickness of the load plug pin, a distance from an edge of the upper recessed platform to the position on the upper slant that is the equal height to the upper recessed platform is no more than the interval of space between the load plug pins.

8. The safety gate of claim 1, wherein:

the upper slide plate and the lower slide plate have a tabular structure, the upper recessed platform is vertically lower than a highest point on the upper slant, and a first horizontal displacement from the highest point on the upper slant to a position on the upper slant with a height equal to the upper recessed platform is no less than the thickness of a load plug pin, the lower recessed platform is vertically lower than a highest point on the lower slant, and a second horizontal displacement from the highest point on the lower slant to a position on the lower slant with a height equal to the lower recessed platform is no less than the thickness of the load plug pin, a first distance from an edge of the upper recessed platform to the position on the upper slant with the height equal to the upper recessed platform is no more than the interval of space between the load plug pins, and a second distance from an edge of the lower recessed platform to the position on the lower slant with the height equal to the lower recessed platform is no more than the interval of space between the load plug pins.

9. The safety gate of claim 1, wherein:

the upper slide plate is a tabular frame component, the lower slide plate is configured in a Z shape, a first end of the lower slide plate comprises the lower slant and the lower slant penetrates through the upper space and is stacked on the upper recessed platform, a first horizontal displacement from a highest point on the upper slant to a position on the upper slant that is an equal height to the upper recessed platform is no less than the thickness of the load plug pin, a second horizontal displacement between a highest point and a lowest point on the lower slant is no less than the thickness of the load plug pin, a distance from an edge of the upper recessed platform to the position on the upper slant that is the equal height to the upper recessed platform is no more than the interval of space between the load plug pins.

10. A safety gate for selectively covering socket holes of an electrical outlet, the safety gate comprising:

an upper slide plate comprising an upper recessed platform, an upper space, and an upper slant;

a lower slide plate comprising a lower slant, a lower space, and a lower recessed platform; and a side slide plate comprising a side slant and a groove, wherein:

the upper space and the lower space are configured to allow load plug pins to pass through, and the upper space and the lower space are spaced apart to correspond to a spacing interval of the load plug pins, the upper recessed platform is on a first side of the upper space and the upper slant is on an opposed side of the upper space, the lower slant is on a first side of the lower space and the lower recessed platform is on an opposed side of the lower space, a slope of the upper slant and a slope of the lower slant are in the same direction, the upper slide plate is stacked with the lower slide plate such that the upper recessed platform overlaps with the lower slant and the upper slant overlaps with the lower recessed platform, at least one of the lower slant or upper slant corresponds to a long slot-shaped socket hole, at least one of the upper recessed platform or the lower recessed platform further comprises a protruding check block, the upper slide plate is configured to slide relative to the lower slide plate, and the lower slide plate is configured to slide relative to the upper slide plate, the slope of the upper slant and the slope of the lower slant are configured to interact with the load plug pins such that the load plug pins slide along the slopes to slidingly displace each of the upper slide plate and the lower slide plate a sliding distance in a direction away from the side slide plate, and the sliding distance for each of the upper slide plate and the lower slide plate is no less than a thickness of a load plug pin, the groove of the side slide plate abuts the protruding check block, the side slide plate is configured to slide in a direction perpendicular to a direction of relative sliding of the upper slide plate and the lower slide plate, and at least one of the upper slant or the lower slant is higher than the side slant so that when at least one of the upper slant or the lower slant interacts with a pin of the load plug, the at least one of the upper slant or the lower slant moves the protruding check block away from the groove.

11. The safety gate of claim 10, wherein:

the safety gate is configured to be installed in the electrical outlet, and the electrical outlet comprises a case and electrodes in the case to match the load plug pins, the case comprises first and second socket holes at positions corresponding to the electrodes, the first socket hole comprises a T-shaped hole with a cross strip and a long strip and the second socket hole comprises the long slot-shaped hole in parallel with the cross strip of the T-shaped hole, the upper slide plate and the lower slide plate are configured to affix to a portion of the case corresponding to the socket holes, the upper slant, the upper recessed platform, the lower slant, and the lower recessed platform are configured to selectively vertically align with and cover one of the cross strip and the long slot-shaped hole, and the side slant is configured to selectively vertically align with the long strip.

12. The safety gate of claim 11, wherein:

the upper slide plate and the lower slide plate have a tabular structure, the upper recessed platform is vertically lower than a highest point on the upper slant, and a first horizontal displacement from the highest point on the upper slant to a position on the upper slant with a height equal to the upper recessed platform is no less than the thickness of the load plug pin, the lower recessed platform is vertically lower than a highest point on the lower slant, and a second horizontal displacement from the highest point on the lower slant to a position on the lower slant with a height equal to the lower recessed platform is no less than the thickness of the load plug pin, a first distance from an edge of the upper recessed platform to the position on the upper slant with the height equal to the upper recessed platform is no more than the spacing interval of the load plug pins, and a second distance from an edge of the lower recessed platform to the position on the lower slant with the height equal to the lower recessed platform is no more than the spacing interval of the load plug pins.

13. The safety gate of claim 11, wherein:

the upper slide plate is a tabular frame component, the lower slide plate is configured in a Z shape, a first end of the lower slide plate comprises the lower slant and the lower slant penetrates through the upper space and is stacked on the upper recessed platform, the protruding check block is provided on an end of the upper recessed platform, a first horizontal displacement from a highest point on the upper slant to a position on the upper slant that is an equal height to the upper recessed platform is no less than a thickness of the load plug pin, a second horizontal displacement between a highest point and the lowest point on the lower slant is no less than the thickness of the load plug pin, a distance from an edge of the upper recessed platform to the position on the upper slant that is the equal height to the upper recessed platform is no more than the spacing interval of the load plug pins.

14. The safety gate of claim 10, further comprising resetting mechanisms, wherein the resetting mechanisms are configured to bias the upper slide plate, the lower slide plate, and the side slide plate against sliding.

15. The safety gate of claim 14, wherein:

the upper slide plate and the lower slide plate have a tabular structure, the upper recessed platform is vertically lower than a highest point on the upper slant, and a first horizontal displacement from the highest point on the upper slant to a position on the upper slant with a height equal to the upper recessed platform is no less than the thickness of the load plug pin, the lower recessed platform is vertically lower than a highest point on the lower slant, and a second horizontal displacement from the highest point on the lower slant to a position on the lower slant with a height equal to the lower recessed platform is no less than the thickness of the load plug pin, a first distance from an edge of the upper recessed platform to the position on the upper slant with the height equal to the upper recessed platform is no more than the spacing interval of the load plug pins, and a second distance from an edge of the lower recessed platform to the position on the lower slant with the height equal to the lower recessed platform is no more than the spacing interval of the load plug pins.

16. The safety gate of claim 14, wherein:

the upper slide plate is a tabular frame component, the lower slide plate is configured in a Z shape, a first end of the lower slide plate comprises the lower slant and the lower slant penetrates through the upper space and is stacked on the upper recessed platform, the protruding check block is provided on an end of the upper recessed platform, a first horizontal displacement from a highest point on the upper slant to a position on the upper slant that is an equal height to the upper recessed platform is no less than a thickness of the load plug pin, a second horizontal displacement between a highest point and the lowest point on the lower slant is no less than the thickness of the load plug pin, a distance from an edge of the upper recessed platform to the position on the upper slant that is the equal height to the upper recessed platform is no more than the spacing interval of the load plug pins.

17. The safety gate of claim 10, wherein:

the upper slide plate and the lower slide plate have a tabular structure, the upper recessed platform is vertically lower than a highest point on the upper slant, and a first horizontal displacement from the highest point on the upper slant to a position on the upper slant with a height equal to the upper recessed platform is no less than the thickness of the load plug pin, the lower recessed platform is vertically lower than a highest point on the lower slant, and a second horizontal displacement from the highest point on the lower slant to a position on the lower slant with a height equal to the lower recessed platform is no less than the thickness of the load plug pin, a first distance from an edge of the upper recessed platform to the position on the upper slant with the height equal to the upper recessed platform is no more than the spacing interval of the load plug pins, and a second distance from an edge of the lower recessed platform to the position on the lower slant with the height equal to the lower recessed platform is no more than the spacing interval of the load plug pins.

18. The safety gate of claim 10, wherein:

the upper slide plate is a tabular frame component, the lower slide plate is configured in a Z shape, a first end of the lower slide plate comprises the lower slant and the lower slant penetrates through the upper space and is stacked on the upper recessed platform, the protruding check block is provided on an end of the upper recessed platform, a first horizontal displacement from a highest point on the upper slant to a position on the upper slant that is an equal height to the upper recessed platform is no less than a thickness of the load plug pin, a second horizontal displacement between a highest point and the lowest point on the lower slant is no less than the thickness of the load plug pin, a distance from an edge of the upper recessed platform to the position on the upper slant that is the equal height to the upper recessed platform is no more than the spacing interval of the load plug pins.

* * * * *